United States Patent [19]

Seery

[11] Patent Number: 4,914,844

[45] Date of Patent: Apr. 10, 1990

[54] DISPLAY ATTACHMENT FOR DOORS

[76] Inventor: Terence J. Seery, 940 22nd St., Moline, Ill. 61265

[21] Appl. No.: 411,778

[22] Filed: Sep. 25, 1989

[51] Int. Cl.[4] ..... G09F 3/18

[52] U.S. Cl. ..... 40/642; 49/67; 47/70; 52/38

[58] Field of Search ..... 49/61, 67, 70, 501; 40/152, 642; 160/371, 379; 52/38, 144, 145

[56] References Cited

U.S. PATENT DOCUMENTS 2,835,325 5/1958 Gilbert ..... 49/501 X
3,783,543 1/1974 Hemgren ..... 40/152
4,389,817 6/1983 Olberding ..... 49/67 X
4,821,440 4/1989 Dunn ..... 40/642

*Primary Examiner*—Gary L. Smith
*Assistant Examiner*—Jerry Redman
*Attorney, Agent, or Firm*—Henderson & Sturm

[57] ABSTRACT

A rectangular frame made up of inwardly facing channels embraces upper and lower panels of relatively rigid light-weight porous or foam material capable of receiving pins, etc., to serve as a bulletin board. One edge of the frame has a pair of vertically spaced ears apertured in vertical alignment for attachement to a door via the hinge pins of the door hinges. The frame is cross-braced at about its midpoint and the cross brace serves also to retain the upper of the two panels against downward shifting.

7 Claims, 2 Drawing Sheets

Fig. 1
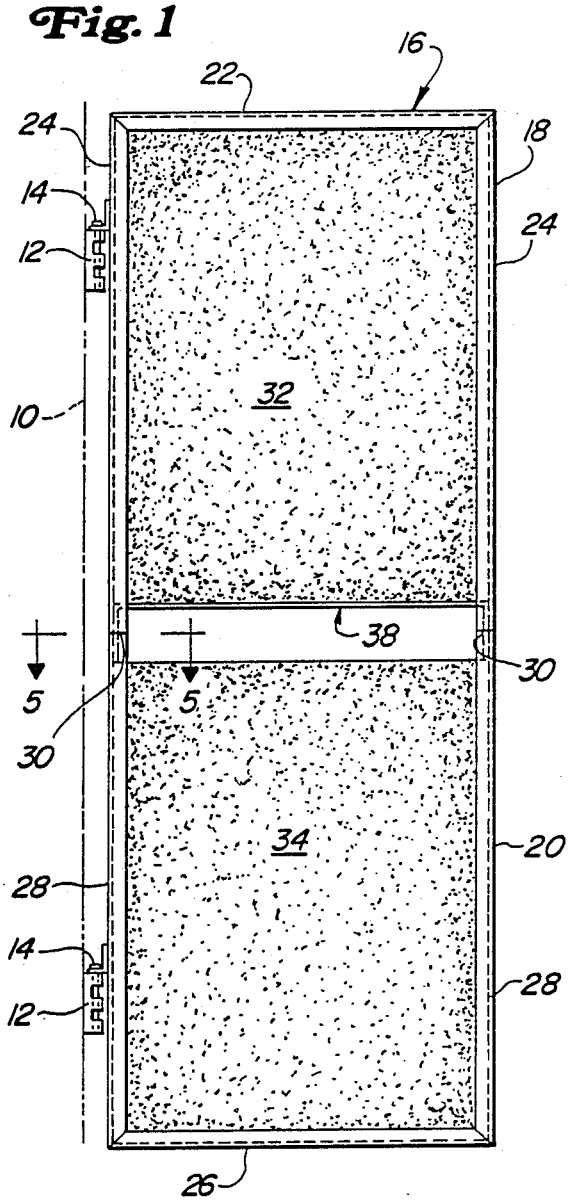
Fig. 2
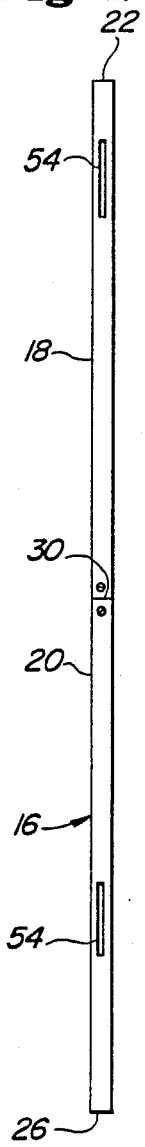
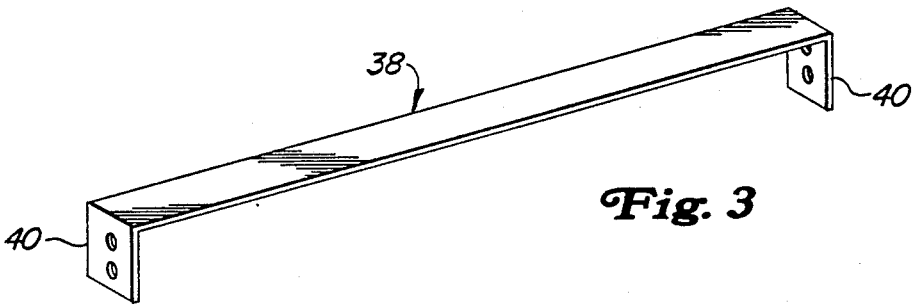
Fig. 3

DISPLAY ATTACHMENT FOR DOORS

BACKGROUND AND SUMMARY OF THE INVENTION

People, and especially youngsters, are prone to use walls, doors, etc., for purposes of attaching notices, memorabilia, as displays, reminders and simple attractiveness. Additionally, business people use walls, doors, etc., for purposes of attaching charts, graphs, schedules and reports as displays. The types of fasteners, pins, tape, etc., eventually cause deterioration of the surfaces and it is conventional practice to provide some form of wall-mounted bulletin board. These of course consume wall space that could be put to better use and require holes and fasteners in the wall. Thus, it is a problem of how best to save the walls without damage and covering large areas thereof with bulletin boards or as areas to which articles, notices, etc., are attached.

This problem is solved according to the present invention by a display panel structure that is attachable to the back of a typical door by means of the hinge pins of the door hinges. It is a feature of the invention that the structure is made up of a rectangular frame in which the verticals and horizontals are inwardly facing channels which receive panel means, preferably in the form of similar upper and lower panels of relatively rigid, light-weight porous or form material capable of receiving and retaining pins and the like by means of which various items can be attached to the panels.

It is a further feature of the invention to provide the frame in such manner that it and its components may be easily packaged and sold in knock-down form for simple assembly by the purchaser. The means for mounting the frame on the door hinges is adjustable to accommodate different vertical spacing of the hinges. A further adjunct is the provision of the frame as upper and lower symmetrical frame halves having legs meeting at horizontally alined junctions and to provide a cross brace which connects and rigidifies the junctions as well as bracing the frame from side to side. In a two-panel structure where the panels are spaced apart vertically at about the midpoint of the assembled frame the cross member also engages the upper panel and retains it against downward shifting.

Features, objects and advantages in addition to the foregoing will appear as a preferred embodiment of the invention is disclosed hereinafter.

DESCRIPTION OF THE DRAWINGS

FIG. 1 is a face view of the structure shown in association with a portion of a typical door.

FIG. 2 is an edge view of the structure.

FIG. 3 is a perspective of the cross member.

DETAILED DESCRIPTION OF A PREFERRED EMBODIMENT OF THE INVENTION

Figure 4:
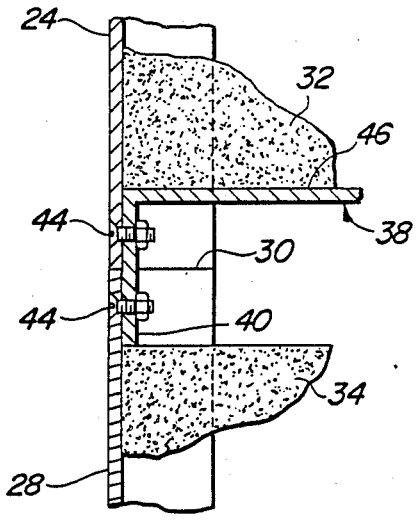
FIG. 4 is an enlarged fragmentary section showing the relationship among one end of the cross member and adjoining legs of the frame.
Figure 5:
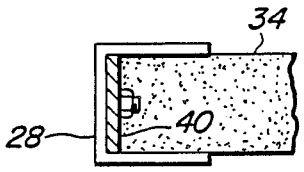
FIG. 5 is a view as seen along the line 5—5 of FIG. 1.

Reference will be had first to FIG. 1 wherein the numeral 10 designates a vertical position of a typical door frame having upper and lower hinges 12 provided typically with removable hinge pins 14. The inventive door attachment comprises a frame 16 made up of upper and lower frame halves 18 and 20. The upper half is of inverted V shape including a top cross member 22 and a pair of depending legs 24, and the lower half is a U-shaped frame half having a lower cross member 26 and a pair of upright legs 28. The frame halves are symmetrically arranged and when assembled the legs meet respectively at horizontally alined junctions 30 so that the legs at each side provide verticals and the cross members provide upper and lower members. Each of the frame parts is a channel with its open side facing inwardly so as to receive panel means, here in the form of upper and lower rectangular panels 32 and 34, each of relatively rigid, light-weight material of foam or porous nature capable of receiving and retaining pins and the like so that the panels serve as bulletin boards, etc. The edges of the panels respectively relatively tightly fit the channels and are dimensioned so that they are vertically spaced apart generally in the area of the leg junctions 30. If desired, each panel may be covered with felt or the like for added attractiveness and pin-holding power. When so formed, the felt, etc., is easily retained by the frame channels.

When assembled, the frame preferably has a smaller area than the door so as not to drag on the floor and also to leave the door knob exposed. Consequently, the frame and panels are dimensioned to "fit" average doors. The frame channels are preferably metal such as aluminum, steel, etc., but may be made of heavy-duty light-weight materials of other types. The relatively tight fit of the panels in the channels adds rigidity to the structure and this is further augmented by a cross brace 38 (FIG. 3) which is dimensined to span the side frames at the junctions 30. This brace has vertical legs 40 which relatively tightly fit the channels while spanning the junction 30, being provided with openings for receiving bolts or equivalent fasteners 44 which pass also through the legs at the respective junctions (FIG. 4). The cross brace also serves to engage the upper panel to prevent downward shifting to that panels as at 46.

Figure 6:
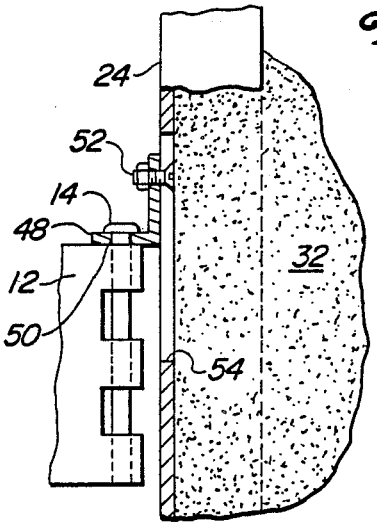
FIG. 6 is an enlarged fragmentary view showing one of the hinge connections.

The assembled frame is mountable on the door hinges via upper and lower mounting ears 48, each apertured at 50 so that the apertures are in vertical alinement. The ear is attached to the frame via a bolt 52 (FIG. 6). In order to accommodate the attachment to differently spaced apart door hinges, the frame includes vertical slots 54 for selective vertical adjustability of the ears.

As previously noted, the frame and hardware components may be sold in known-down fashion, making for an economical product. The bolts are preferably flat heads so as to minimize protuberances. The mounting via the hinge pins is simple, by removing the pins and reinstalling them through the respective mounting ears. The structure is swingable of course relative to the door, thus enabling use of both sides of the panels.

Modifications in and additions to the preferred embodiment will readily occur to those versed in the art, all without departure from the spirit and scope of the invention.

I claim:

1. A display structure for attachment to a typical door mounted on upper and lower hinges including removable hinge pins, comprising a rectangular frame made up of opposite upright channels cross-connected by upper and lower cross channels, all channels having their open sides facing inwardly, rectangular panel means within and carried by the frame with edges of the panel means fitting the channels, said panel means being formed of relatively rigid, light-weight porous material capable of being penetrated by pins and fasteners so as to function as a bulletin board and upper and lower mounting ears carried by one of the upright channels and projecting outwardly, said ears being apertured in vertical alinement to be received respectively by the upper and lower hinge pins.

2. The structure according to claim 1, in which the mounting ears are selectively vertically adjustable to accommodate different vertical spacing of door hinges.

3. The structure according to claim 1, in which the panel means comprises upper and lower panels spaced vertically apart at about the mid-point of the height of the structure, and retaining means is provided for preventing downward displacement of the upper panel relative to the frame.

4. The structure according to claim 3, in which the retaining means comprises a cross member connected at opposite ends to and spanning the upright channels just below and engaged by the upper panel.

5. The structure according to claim 4, in which the frame comprises an upper half of inverted U shape including the upper cross channel and opposite legs forming upper halves of the upright channels, a lower half of U shape including the lower cross channel and opposite legs forming the lower halves of the upright channels, the upper and lower legs meeting at a junction between the upper and lower panels, and the retaining means has opposite ends spanning the junctions of the legs and securing the frame halves together.

6. The structure according to claim 5, in which the opposite ends of the retaining means are elongated in the vertical direction and tightly fit the respective channels so as to rigidify the respective junctions.

7. The structure according to claim 5, in which each frame half is foldable at its corners, the panels are removably fittable respectively into the unfolded frame halves, and the retaining means is removably attached to the legs when the halves are assembled with the panels.

* * * * *